US006102375A

United States Patent [19]

Colless et al.

[11] Patent Number: 6,102,375

[45] Date of Patent: Aug. 15, 2000

[54] CROWD CONTROL BARRIER

[75] Inventors: Geoffrey Malcolm Colless, Rainworth; Glen Irving Cleland, Tingalpa, both of Australia

[73] Assignee: Geoffrey Malcolm Colless, State of Queensland, Australia

[21] Appl. No.: 09/180,033

[22] PCT Filed: Apr. 30, 1997

[86] PCT No.: PCT/AU97/00261

§ 371 Date: Oct. 30, 1998

§ 102(e) Date: Oct. 30, 1998

[87] PCT Pub. No.: WO97/41306

PCT Pub. Date: Nov. 6, 1997

[30] Foreign Application Priority Data

| | | | |
|---|---|---|---|
| May 1, 1996 | [AU] | Australia | PN9615 |
| Jan. 3, 1997 | [AU] | Australia | PO4470 |

[51] Int. Cl.[7] ..... E04H 17/16

[52] U.S. Cl. ..... 256/26; 256/12; 256/13.1; 256/19

[58] Field of Search ..... 256/13.1, 19, 24, 256/26, 1, 11, 12

[56] References Cited

U.S. PATENT DOCUMENTS

| | | | |
|---|---|---|---|
| 259,654 | 6/1882 | Worthington | 256/12 |
| 321,171 | 6/1885 | Archibald | 256/12 |
| 435,708 | 9/1890 | Poole | 256/12 |
| 511,700 | 12/1893 | Jacobs | 256/12 |
| 3,767,167 | 10/1973 | Rasmussen | 256/26 |
| 3,865,309 | 2/1975 | Greenhalgh | 256/1 |
| 4,681,302 | 7/1987 | Thompson . | |
| 4,925,333 | 5/1990 | Bishop . | |
| 5,011,325 | 4/1991 | Antonioli | 256/13.1 |
| 5,123,773 | 6/1992 | Yodock | 256/13.1 |
| 5,143,354 | 9/1992 | Nolan | 256/12 |
| 5,213,312 | 5/1993 | MacDonald | 256/26 |
| 5,882,140 | 3/1999 | Yodock, Jr. et al. | 256/13.1 |

FOREIGN PATENT DOCUMENTS

| | | | |
|---|---|---|---|
| 50241/93 | 8/1994 | Australia . | |
| 65709/96 | 12/1996 | Australia . | |
| 1 214 347 | of 0000 | Canada . | |
| 71348 | 8/1991 | Czechoslovakia | 256/13.1 |
| 407277 | 1/1991 | European Pat. Off. | 256/13.1 |
| 442249 | 8/1991 | European Pat. Off. | 256/13.1 |
| 0 564 393 | 10/1993 | European Pat. Off. . | |
| 0 589 605 | 3/1994 | European Pat. Off. . | |
| 43 20 720 | 12/1994 | Germany . | |
| 676 864 | 3/1991 | Switzerland . | |
| 683540 | 3/1994 | Switzerland . | |
| 2 248 867 | 4/1992 | United Kingdom . | |

OTHER PUBLICATIONS

Deerwent Abstract Accession No. 93–150346/18, Class Q41, SU 1733549 A (Kryukovo Wagon WKS) May 15, 1992.

*Primary Examiner*—Lynne H. Browne
*Assistant Examiner*—David E. Bochna
*Attorney, Agent, or Firm*—Quarles & Brady LLP

[57] ABSTRACT

A barrier module having an elongate hollow base portion adapted to rest on the ground or equivalent surface and to be filled with liquid, preferably water. The module also includes an elongate upper portion disposed above the base portion, and a wall the base portion and the upper portion and forming a barrier to prevent passage of persons therebetween. The upper portion has an outwardly and downwardly curved upper surface extending from one side of the wall means to the other side of the wall means to make gripping of the upper portion difficult, thereby inhibiting scaling of the barrier.

16 Claims, 5 Drawing Sheets

CROWD CONTROL BARRIER

TECHNICAL FIELD OF THE INVENTION

THIS INVENTION relates to improved barriers and modules therefor, and it has particular but not exclusive reference to crowd-control barriers for the purpose of defining routes which pedestrians or vehicles should follow and for preventing access to specific areas, particularly those which may suitably be patrolled by police or other persons in authority.

Controlling crowds by means other than generally immovable fences of a rigid or permanent nature is becoming increasingly necessary. Street marchers, sports spectators and other enthusiastic groups of people can quickly constitute a crowd whose advancement cannot be repelled by the available police or other persons in authority, so that damage to the person or to property will ensue.

BACKGROUND ART

Various types of portable or transportable barriers are known but typically those are all directed to the guidance of vehicular traffic or the protection of persons from vehicular traffic particularly at locations where roadworks are being carried out.

For example, Swiss Patent Application Nos. 676864 and 683540 to SEROC SA illustrates a traffic barrier having a concrete base and a pair of spaced apart guide rails disposed above the base, but this barrier is low level only and can be easily scaled so is not effective for crowd control. European Patent Application no. 589605 to Energy Absorption Systems Inc illustrates a hollow barrier module for traffic control but this module is also ineffective for crowd control as it can be easily scaled, the ridges provided therein allowing an effective purchase for climbing.

Thus, there is a need for a novel form of barrier which may be erected quickly and easily at a desired location and will prove effective for crowd control, and accordingly the principal object of the present invention is to meet the demand for such barriers.

Another object of the invention is to provide conveniently sized barrier modules which may easily be assembled to form a barrier for crowd control, the modules once positioned and interconnected, being adapted for filling with liquid so that weight and stability will be increased and being able to be emptied after use so that transportability to other sites will be restored.

Yet another object of the invention is to provide barrier modules designed so that maximum compactness is achieved, without undue bulk, but which cannot be scaled by a rioter or truant under normal conditions. It is another object to provide barrier modules which once connected to adjacent modules cannot easily be detached by rioters or truants or tipped by such persons under normal conditions. It is a further object to provide modules of the character described which allow viewing therethrough for crowd observation by the authorities, and/or to enable the easy passing of instructions, and/or for visible threatening with brandished weapons, but without significantly reducing the security benefits by facilitating scaling by crowd members. Other objects and advantages of the invention will become clear from the embodiments later described.

DISCLOSURE OF THE INVENTION

With the foregoing and other objects in view, the invention in one aspect resides broadly in a barrier module including:

an elongate hollow base portion adapted to rest on the ground or equivalent surface and to be filled with liquid, preferably water;

an elongate upper portion disposed above said base portion; and wall means connecting said base portion and said upper portion and forming a barrier to prevent passage of persons therebetween, said upper portion having an outwardly and downwardly curved upper surface extending from one side of said wall means to the other side of said wall means to make gripping of said upper portion difficult thereby to inhibit scaling of said barrier module.

In another aspect the invention resides broadly in a barrier module including:

an elongate hollow base portion adapted to rest on the ground or equivalent surface and to be filled with liquid, preferably water;

an elongate upper portion disposed above said base portion; and wall means connecting said base portion and said upper portion and forming a barrier therebetween, said upper portion having an outwardly and downwardly curved upper surface extending from one side of said wall means to the other side of said wall means to make gripping of said upper portion difficult thereby to inhibit scaling of said barrier module, said wall means including a plurality of spaced apart elongate members or portions adapted to generally prevent passage of persons therebetween.

In another aspect the invention resides broadly in a barrier module including:

an elongate hollow base portion adapted to rest on the ground or equivalent surface and to be filled with liquid, preferably water;

an elongate upper portion disposed above said base portion; and wall means connecting said base portion and said upper portion and forming a barrier to prevent passage of persons therebetween, said base portion and said upper portion being of greater lateral dimension than said wall means so as to inhibit scaling of said barrier module.

In yet another aspect the invention resides broadly in a barrier module including:

an elongate hollow base portion adapted to rest on the ground or equivalent surface and to be filled with liquid, preferably water;

an elongate upper portion disposed above said base portion; and wall means connecting said base portion and said upper portion and forming a barrier therebetween, said base portion and said upper portion being of greater lateral dimension than said wall means and said upper portion having an outwardly and downwardly curved upper surface extending from one side of said wall means to the other side of said wall means to make gripping of said upper portion difficult thereby to inhibit scaling of said barrier module, said wall means including a plurality of spaced apart elongate members or portions extending upwardly from said base portion to said upper portion adapted to generally prevent passage of persons therebetween.

Preferably, the upper portion is substantially cylindrical in form providing upper and lower curved surfaces making gripping by a would-be scaler even more difficult. It is also preferred that the upper surface of the base portion be outwardly and downwardly curved so that a would-be scaler would have difficulty in maintaining a stable stance thereon and in obtaining an effective purchase for climbing the barrier module.

Preferably, said elongate members or portions are shaped to allow visibility of the area on one side of and beyond the barrier module to a viewer standing on the other side whereby the viewer can determine the size, state of agitation and other relevant aspects of a crowd on one side of the barrier module from a protected position on the other side. Advantageously, the spacing and shaping of said elongate members allows crowd control authorities such as the police to control riots and other disturbances and if necessary the authorities can utilise water canon or other devices through the apertures or spaces to disperse a crowd. It is also preferred that said elongate members or portions be hollow so that they can be filled with liquid to increase the weight of the module and also to provide a path for liquid communication between said base portion and said upper portion which in a preferred form are both also hollow and whereby the whole barrier module can be filled with liquid from one filling opening.

Preferably, the barrier module includes coupling means for coupling one module to adjacent modules and preferably such coupling means is adapted to prevent release of an intermediate module from the adjacent modules. In a preferred form the coupling means includes a pair of aligned downwardly directed upper and lower pins provided at one end of the module and complementary aligned upper and lower sockets provided at the other end, whereby in use, the pins of one module may engage in the respective sockets of an adjacent barrier module. It will be appreciated that in such form of the invention the modules must be coupled and uncoupled from a free end of a barrier comprising a plurality of barrier modules, the weight of each module when filled with water being effective to prevent release of an intermediate module. Furthermore, in those forms of the invention in which the wall means includes a plurality of spaced apart elongate members extending from the base portion to the upper portion, the coupling means is arranged such that the end elongate member of one module is spaced from the end elongate member of the adjacent module by substantially the same distance as the elongate members of each module, whereby visibility through the wall means for all parts of a barrier comprising a plurality of coupled modules is maintained and the wall means of adjacent barrier modules cooperate to form a continuous barrier of substantially evenly spaced members.

Preferably the base portion is shaped at its ends to allow pivoting movement of adjacent modules in the horizontal plane to form barrier corners. In a preferred from the ends are curved to allow pivoting movement through an angle of 45 degrees such that adjacent barrier modules can enclose a minimum of 135 degrees and in one such form the upper surfaces of the base portion at the ends are substantially part-spherical in form, whilst the ends of the upper portion are substantially hemispherical in form and adapted to abut the opposed ends of an adjacent barrier module.

In a practical embodiment, a typical module may be substantially square in side elevation, a suitable height being 2100 mm to satisfactorily inhibit scaling by adult persons, and with the same length for stability and so that the weight when filled with water will be effective to prevent tipping manually by persons or groups of persons in a crowd. The base portion in such typical embodiment is suitably semi-cylindrical about a base or diametral dimension of 1200 mm in the lateral direction, resting on suitable bearing means such as pads, and having its curved face uppermost and with the wall means comprising a plurality of vertical connecting pipes or tubes extending from the uppermost medial longitudinal line of the base portion. The upper elongate section in such typical embodiment may be cylindrical having a diameter of about 600 mm with the curved undersurface being connected to the pipes or tubes medially of its width so that there is an overhang at each side. It will be seen that in a typical embodiment the dimensions of the various portions of the barrier module are effective to generally prevent groups of persons from tipping a module onto its side without machine assistance as well as being effective to prevent or at least greatly inhibit scaling. Furthermore, the size, proportion and curvature of the various portions of the barrier module make it very difficult if not impossible for chains of people one behind the other to topple the module.

In another aspect the invention resides broadly in a barrier module including:

an elongate hollow base portion adapted to rest on the ground or equivalent surface and to be filled with a liquid, preferably water;

wall means extending upwardly from said base portion; and an upper portion disposed above said base portion and operatively connected to said wall means for rotation relative thereto. In such form of the invention it is preferred that said upper portion comprises a roller or a plurality of rollers. In one form such rollers are mounted to extensions of said wall means and are cylindrical in form having the axis or axes of rotation substantially parallel to the longitudinal axis of the elongate base portion. However, in other forms such rollers may be freely mounted for rotation in a dish formed in the upper end of the wall means and may be cylindrical or spherical in form. It is also preferred that other corresponding features of the module be as described in relation to the other aspects of the invention.

It will be understood that the barrier module in any of its aforementioned aspects may include other features such as quick-release fittings at top and bottom whereby water may be introduced or removed, respectively, when desired and still other features of the invention will be apparent from the following description.

BRIEF DESCRIPTION OF DRAWINGS

In order that the invention may be more readily understood and put into practical effect, reference will now be made to the accompanying drawings, wherein:

FIG. 9*a* is a side elevation of yet another barrier module according to the invention;

FIG. 9*b* is a plan view of the barrier module of FIG. 9*a;*

FIGS. 9*c* and 9*d* are end elevations of the barrier module of FIG. 9*a;*

FIG. 9*e* is a sectional elevation of the barrier module of FIG. 9*a.

DETAILED DESCRIPTION OF DRAWINGS

Referring initially to FIGS. 1 to 4 of the drawings, the barrier module indicated generally at 10 will be seen to include an elongate hollow base portion 11 adapted to rest on the ground and to be filled with water, the base portion 11 being connected by a plurality of spaced apart elongate tubes 17 to an overhead elongate top section 13 which is also semi-cylindrical and parallel to the base portion 11, the tubes forming a barrier or wall indicated generally at 12.

Figure 1:
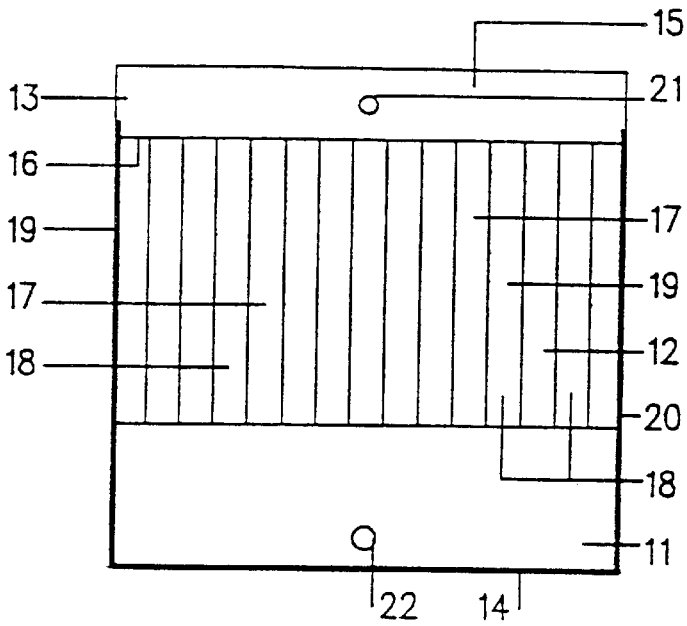
FIG. 1 shows in side elevation one illustrative form of barrier module according to the invention.
Figure 2B:
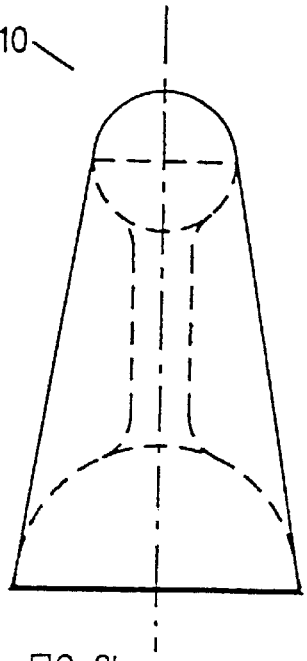
FIGS. 2*a* and 3*a* are end elevational and sectional end elevational views of the module of FIG. 1 and FIGS. 2*b* and 3*b* are end elevational and sectional end elevation views of another module similar to that of FIGS. 2*a* and 3*a;*

In this instance, the overall height is nominally 2100 mm, the length being the same, while the flat base 14 of the base portion 11 is suitably 1200 mm in the transverse of lateral direction. The upper portion or top section 13 is of lesser width, its semi-cylindrical upper surface 15 extending up from a flat lower surface 16 of say 600 mm in the transverse direction. The upper portion 13 is disposed directly above the base portion and connected medially by the tubes 17 which in this instance are eight in number being 150 mm in diameter and equally-spaced so that there are openings 18 between adjacent tubes of about 120 mm width, permitting broad scope of vision from one side of the module to the other and permitting brandishment of weapons by police or other persons in authority as well as preventing passage of adult persons therebetween. The tubes being hollow are adapted to be filled with water like the upper and base portions and also provide a conduit therebetween so that water need only be pumped in one or the other to fill the whole module. In this embodiment, there is at each end an end flange 19 to increase stability and having its edges 20 arranged as tangents from the upper and base semi-cylindrical portions 13 and 11. As shown in FIG. 1, there is an upper quick-release fitting 21 so that an operator may open the inlet for entry of water through a hose for example, and there is a lower quick-release fitting 22 so that an operator may use an unlocking key to permit water to be emptied.

Figure 4:
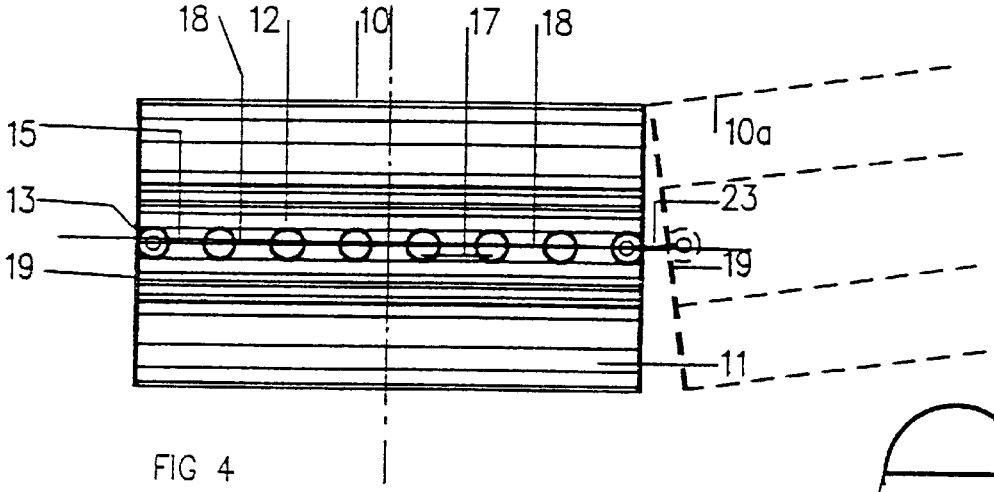
FIG. 4 shows the module of FIGS. 1 to 3 in plan view.
Figure 3B:
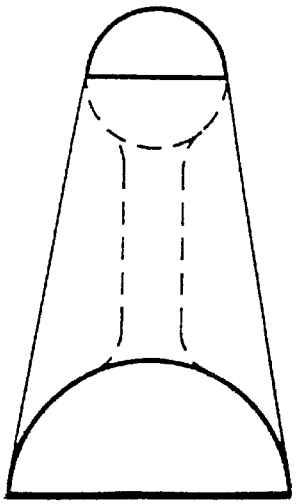
Figure 2A:
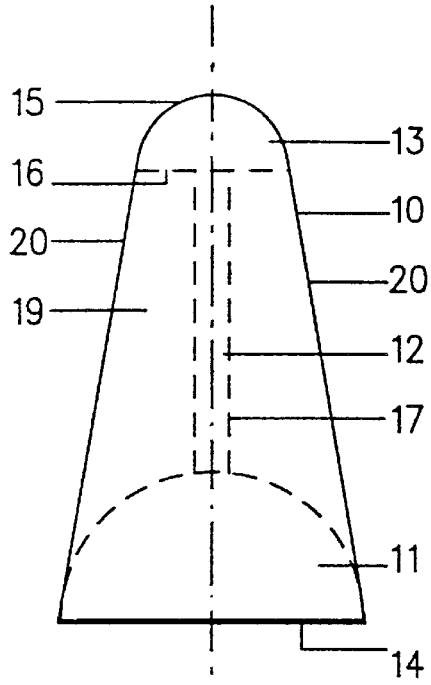
Figure 3A:
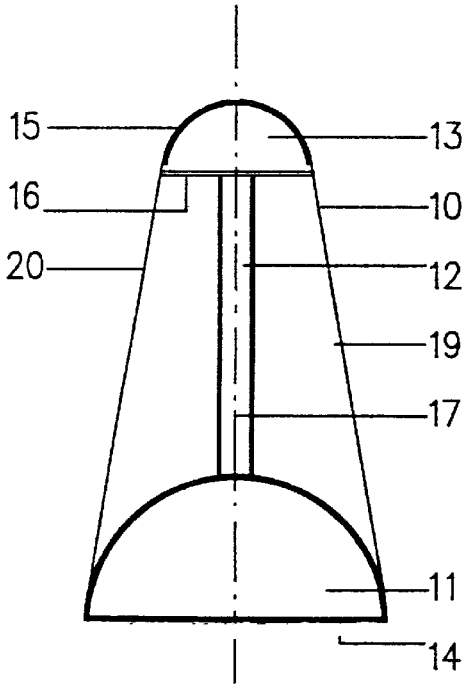

As shown in FIG. 4, the module 10 may be connected to an adjacent module 10*a* by a removable coupler 23 engaging between the adjacent modules from above where it cannot be tampered with in normal usage and designed to allow movement between modules, providing a minimum 10 degrees of movement, as apparent from FIG. 4. Whilst the tubes of this embodiment are circular in cross section, in other embodiments they can be as desired to suit preferred moulding techniques, being of circular cross-section, or diamond, or square, or ellipsoidal for example.

Conventional rotational moulding techniques may be used for moulding the modules as one-piece articles out of suitable plastics materials such as UV-retardant polyethylene, but any suitable materials could be employed, and other moulding techniques could be used as will be apparent to persons skilled in moulding.

Figure 5:
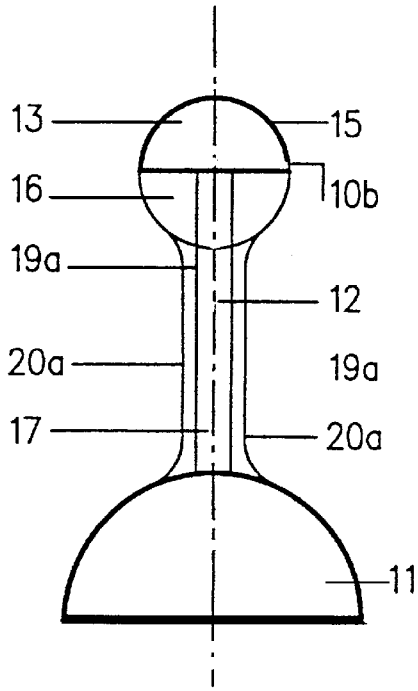
FIG. 5 is a view similar to FIG. 3 but showing in sectional elevation a modified form of barrier module.

In the modified form of module 10*b* shown in FIG. 5, all components are as before and the same numerals are attached accordingly, except that the end flanges 19*a* are of reduced width and have their edges 20*a* substantially vertical, it being considered that this will reduce the flange area available for a would-be scaler to attempt to utilise. In both embodiments, it will be apparent that the base portion gives maximum stability with a low centre of gravity and an insufficient "step" to elevate a person on the sloped top face to a height less than 1500 mm (or five feet) from the top extremity. The vertical tubes 17 provide no assistance to climbers, and the latter will find that they derive no gripping assistance from the nature and shape of the top section or portion 13.

Referring now to FIG. 6*a* to FIG. 8, the barrier module 110 includes an elongate hollow base portion 111 being semi-cylindrical in form and an upper portion 113 substantially cylindrical in form and disposed directly above the base portion and connected thereto by seven equally spaced apart tubes 117 to form a wall 112 with vertical passages 118 between adjacent tubes. In this embodiment the tubes 117 are substantially elliptical in cross-section flaring outwardly at their lower ends to join with the curved upper surface 115 of the base portion 111 and also at their upper ends to join with the curved lower surface of the upper portion. It will be seen that the upper surface of the upper portion curves outwardly and downwardly from a medial plane extending vertically through the module along its length to each side of the tubes 117, the upper portion having a greater lateral dimension than the tubes.

It will be seen that the major axis of the elliptical cross section of the tubes 117 extends laterally of the barrier module providing additional strength in that direction and that the field of vision between the tubes is virtually unrestricted there being only a very small region immediately adjacent each tube which may be blind to a viewer on the other side. Advantageously, the vertical tubes allow the use of water canon or even other forms of crowd control through the barrier.

Figure 6A:
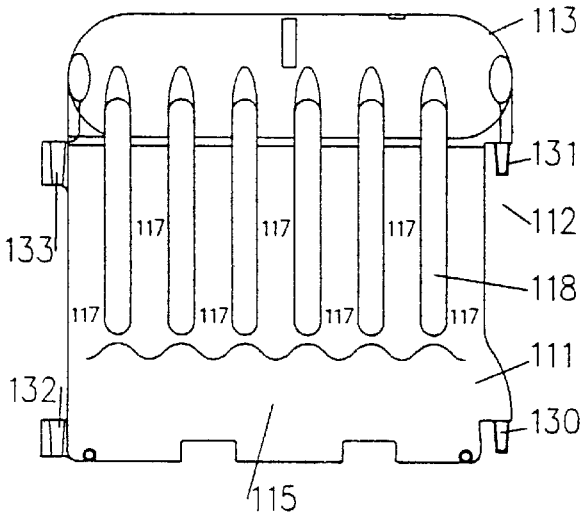
FIG. 6*a* is a side elevation of another form of barrier module according to the invention.
Figure 6C:
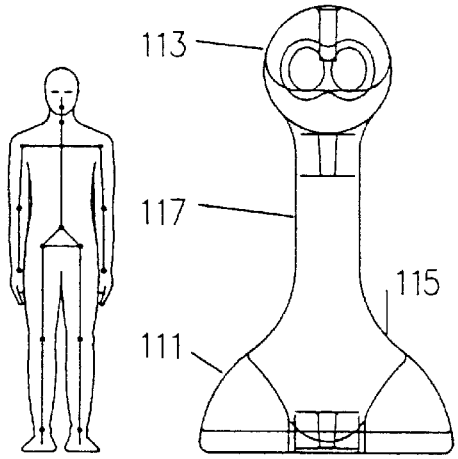
FIG. 6*c* is an end elevation of the module of FIG. 6*a;*
Figure 6B:
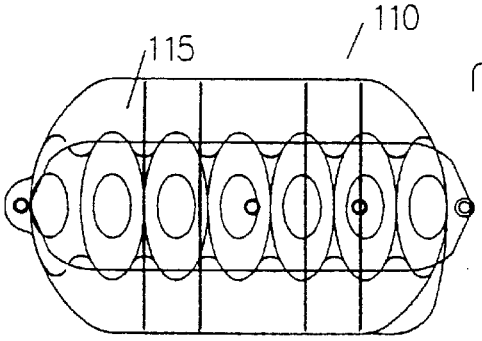
FIG. 6*b* is a plan view of the module of FIG. 6*a;*
Figure 6D:
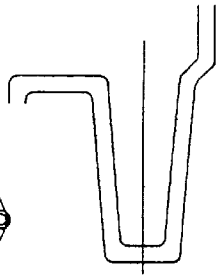
FIG. 6*d* is an enlarged sectional view of the pin of the module of FIG. 6*a;*
Figure 8:
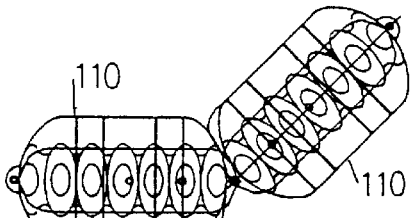
FIG. 8 is a plan view of two of the modules as illustrated in FIG. 6*a* coupled together out of alignment and enclosing an angle of 135 degrees.
Figures 9A, 9B, 9C, 9D, 9E:
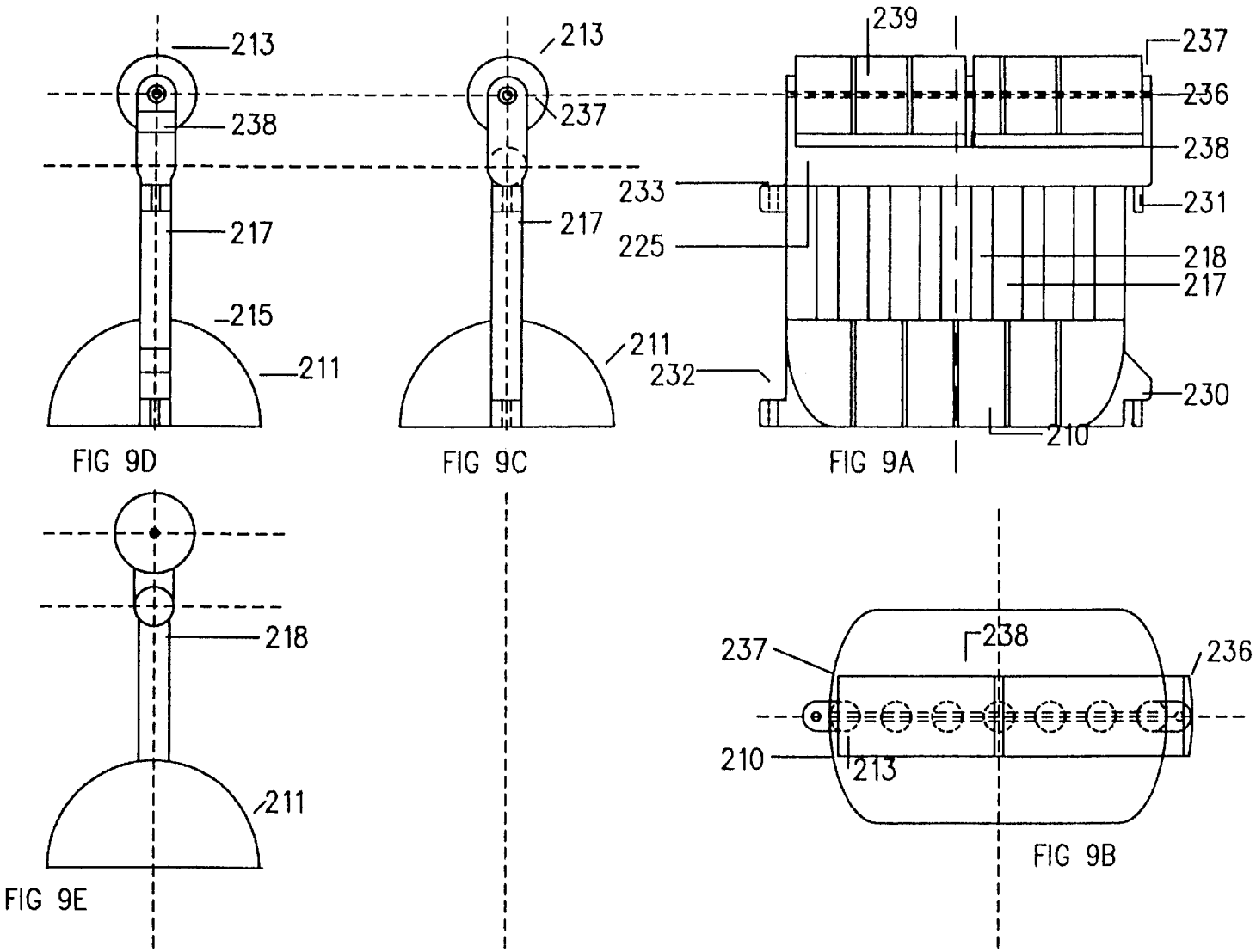
Figure 10:
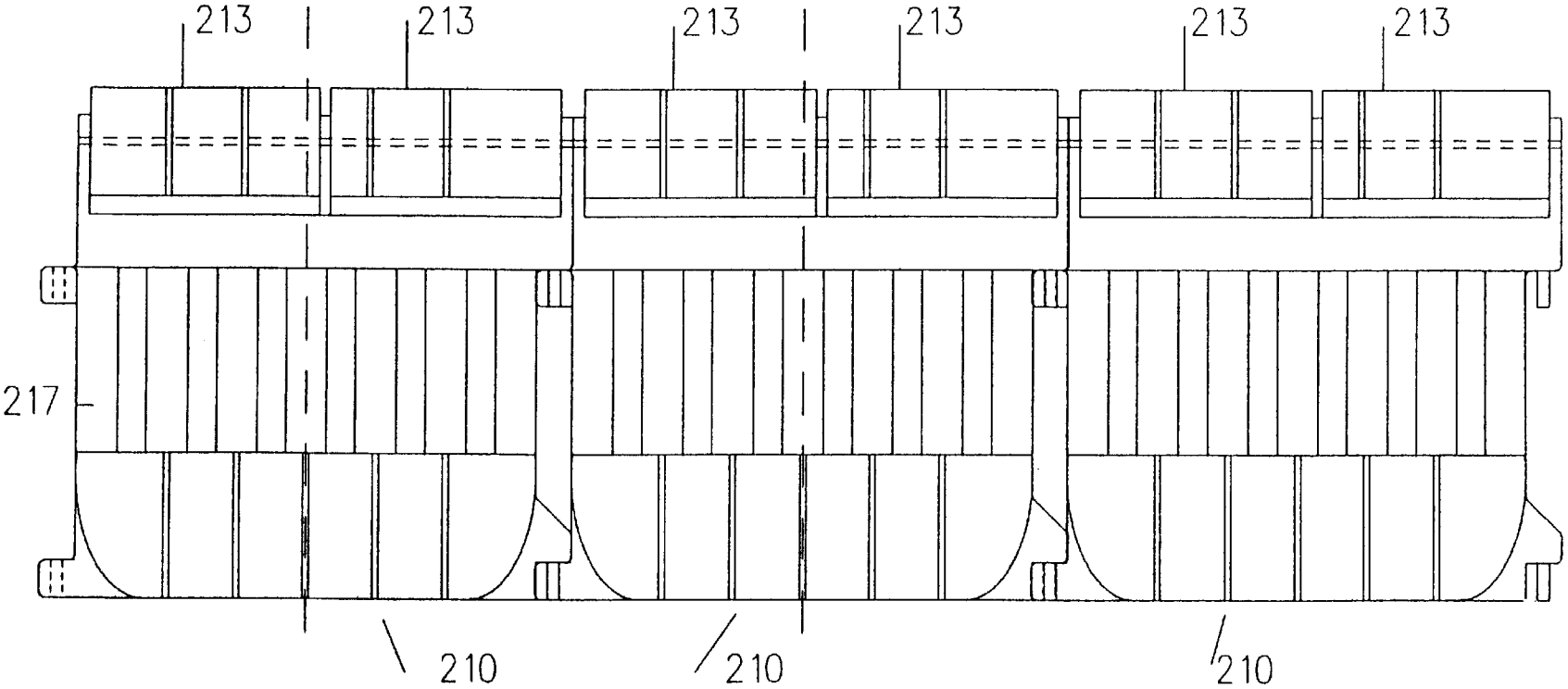
* and FIG. 10 is a side elevation of three barrier modules as illustrated in FIG. 9*a* coupled together to form a barrier.

In this embodiment the ends of the base portion 111 are curved, as more clearly shown in FIG. 6*b,* the ends being more or less part-spherical in form. Similarly the ends of the upper portion 113 are curved, being substantially hemi-spherical in form due to the cylindrical shape of the upper portion. It will be appreciated that the curved forms of the base portion and upper portion allow coupled barrier modules to be pivoted relative to each other in the horizontal plane to form a barrier corner as illustrated in FIG. 8. In this embodiment the curvature and the coupling means are such that the adjacent barrier modules can be pivoted to enclose an angle of 135 degrees so that only three modules are required to form a corner of 90 degrees.

Figure 7:
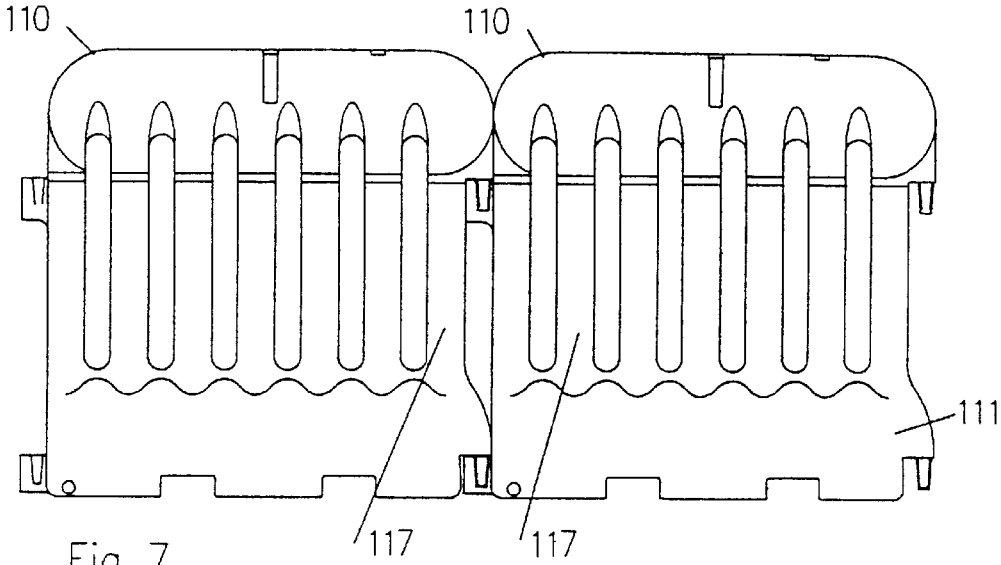
FIG. 7 is a side elevation of two of the modules as illustrated in FIG. 6*a* coupled together in alignment.

The barrier module of FIGS. 6*a* to 8 include downwardly directed pins 130 and 131 extending from the base portion and upper portion respectively at one end thereof and in vertical and horizontal alignment. The pins are adapted to engage in complementary sockets 132 and 133 respectively formed in lugs extending outwardly from the other end of the barrier module but on an adjacent module as illustrated in FIG. 7 and FIG. 8.

It will be seen in FIG. 7 that the pins and sockets are arranged such that the spacing between the adjacent end tubes 117 is substantially equal to the spacing between intermediate tubes 117 whereby the field of vision is substantially the same throughout the length of the barrier comprising the two barrier modules. It will also be appreciated that in circumstances where a plurality of modules are coupled together, an intermediate module cannot be disengaged from the adjacent two modules as a barrier module must be lifted to release the pins from their respective sockets and in lifting one module the adjacent module at the other end will also be lifted.

Referring now to the embodiment illustrated in FIGS. 9*a* to 9*e* and FIG. 10 the barrier module 210 includes a base portion 211 of similar form to the base portion 111 previously described and a plurality of tubes 217 upstanding from the base portion and similar to the tubes 117 but which are interconnected at their upper ends by an intermediate portion 225 of substantially the same lateral dimension as the tubes and forming a manifold. Opposing end flanges 236 and 237 and an intermediate flange 238 extend upwardly from the connecting portion 225 for rotatably mounting a cylindrical upper portion 213 about a shaft 239 which is journalled in bearings located medially of the flanges 236, 237 and 238. Other forms of mounting the upper portion 213 such as stub axles and sockets could be utilised if desired.

In this embodiment it will appreciated that any would-be scaler of the barrier module will be inhibited by rolling of the upper portion 213 so that a grip cannot be maintained. Furthermore it will be seen that barrier module 210 includes pins and sockets 230 to 233 respectively of similar form to the pins and sockets 130 to 133 described in relation to the barrier module 110.

Barriers and modules therefor as described and illustrated will therefor be found very effective in achieving the aforestated objects for which the invention has been devised. With or without minor modifications, they may also replace water-filled road-lining modules currently employed to define the edges of traffic routes, particularly for example where roadworks are being carried out. It is believed that the modules may be made with an empty weight as low as 75 kg so that they may be moved around quite easily and quickly for their various purposes, while their weight when filled with water may be in the order of 500 kg so that they will not be easily dislodged while serving any particular intended purpose.

It will of course be understood that the embodiments given herein are illustrative only and that many further modifications of constructional detail and design may be made, as will be readily apparent to persons knowledgeable in the field concerned, without departing from the broad scope and ambit of the invention, the general nature thereof having been set forth herein.

What is claimed is:

1. A barrier module including:

an elongate hollow base portion adapted to rest on the ground or equivalent surface and to be filled with liquid, preferably water;

an elongate upper portion disposed above said base portion; and wall means connecting said base portion and said upper portion and forming a barrier therebetween, said base portion and said upper portion being of greater lateral dimension than said wall means and said upper portion having an outwardly and downwardly curved upper surface extending from one side of said wall means to the other side of said wall means to make gripping of said upper portion difficult thereby to inhibit scaling of said barrier module, said wall means including a plurality of spaced apart elongate members or portions extending upwardly from said base portion to said upper portion and adapted to generally prevent passage of persons therebetween and said base portion having a curved upper surface extending outwardly and downwardly away from said elongate members or portions to inhibit persons obtaining a foothold thereon.

2. A barrier module according to claim 1, wherein said upper portion is substantially cylindrical in form.

3. A barrier module according to claim 1, wherein said base portion is substantially semi-cylindrical in form.

4. A barrier module according to claim 1, wherein said elongate members or portions are shaped to allow visibility of the area on one side of and beyond the barrier module to a viewer standing on the other side whereby the viewer can determine the size, state of agitation and other relevant aspects of a crowd on one side of the barrier module for the purpose of crowd control from a protected position on the other side of said barrier module.

5. A barrier module according to claim 4, wherein said elongate members or portions are elliptical or oval in cross-section and the major axis of said elliptical or oval cross-section is generally perpendicular to said wall means.

6. A barrier module according to claim 1, wherein said upper portion and said elongate members or portions are hollow and in liquid communication with said base portion.

7. A barrier module according to claim 1, including coupling means for coupling one module to adjacent modules.

8. A barrier module according to claim 7, wherein said coupling means is adapted to prevent release of an intermediate module from the adjacent modules.

9. A barrier module according to claim 8, wherein said coupling means includes a pair of aligned downwardly directed upper and lower pins provided at one end of the module and complementary aligned upper and lower sockets provided at the other end, whereby in use, the pins of one module may engage in the respective sockets of an adjacent barrier module.

10. A barrier module according to claim 9, wherein said coupling means is arranged such that the end elongate member or portion of one module is spaced from the end elongate member or portion of the adjacent module by substantially the same distance as the elongate members or portions of each module.

11. A barrier module according claim 1, wherein said base portion is shaped at its ends to allow pivoting movement of adjacent modules in the horizontal plane.

12. A barrier module according to claim 11, wherein the ends of said base portion are curved to allow pivoting movement through an angle of approximately 45 degrees.

13. A barrier module according to claim 12, wherein the upper surfaces of said base portion at the respective ends are substantially part-spherical in form and the respective ends of said upper portion are substantially hemispherical in form and adapted to abut the opposed ends of the base portion and upper portion of an adjacent barrier module respectively.

14. A barrier module according to claim 1, wherein the overall height of the barrier is approximately 2100 mm or greater.

15. A barrier module according to claim 14, wherein said base portion is semi-cylindrical about a base wall having a diametral dimension of about 1200 mm in the lateral direction and having its curved face uppermost, and said upper elongate section is cylindrical in form having a diameter of about 600 mm with its curved undersurface being connected to said plurality of elongate members medially of its width.

16. A barrier module according to claim 1, wherein said upper portion comprises a cylindrical roller or a plurality of cylindrical rollers operatively connected to said wall means for rotation about an axis or axes extending substantially parallel to the longitudinal axis of said elongate base portion.

* * * * *